United States Patent [19]

Heydweiller

[11] 4,295,020

[45] Oct. 13, 1981

[54] ELECTRICAL SWITCH MECHANISM

[75] Inventor: James Heydweiller, Rochester, N.Y.

[73] Assignee: General Signal Corporation, Rochester, N.Y.

[21] Appl. No.: 106,568

[22] Filed: Dec. 26, 1979

[51] Int. Cl.[3] ..... H01H 35/14

[52] U.S. Cl. ..... 200/61.45 R; 200/61.48; 200/61.52

[58] Field of Search ..... 200/61.45 R, 61.45 M, 200/61.48–61.52

[56] References Cited

U.S. PATENT DOCUMENTS

| | | | |
|---|---|---|---|
| 2,152,256 | 3/1939 | Hewitt | 200/61.48 |
| 3,084,233 | 4/1963 | Von Ohlsen | 200/61.52 |
| 3,161,739 | 12/1964 | Suozzo | 200/61.52 |
| 3,886,339 | 5/1975 | Jubenville | 200/61.45 M |

*Primary Examiner*—James R. Scott

*Attorney, Agent, or Firm*—Martin LuKacher; Milton E. Kleinman

[57] ABSTRACT

An electrical switch mechanism which operates in response to predetermined deceleration and/or acceleration is especially adapted for use on board trains for brake assurance purposes. Switch contacts biased to a safe switching condition are actuated by an arm. A pendulum pivots a predetermined distance with respect to the vertical in response to a predetermined acceleration or deceleration. The arm is carried by the pendulum and may be mounted on a bracket plate such that the arm is set at a predetermined inclination with respect to the vertical. The arm actuates the switch contact only when the train reaches the predetermined acceleration or deceleration. The switch mechanism is vital in operation in that the safe switching state is maintained in the absence of actuation. By adjustment of the bracket and arm inclination, the mechanism can be set to respond to different selected accelerations and/or decelerations. Two sets of contacts biased in opposite directions may be actuated by separate arms each carried by the pendulum. The mechanism is then responsive to deceleration in opposite directions and is especially useful in trains which run in opposite directions without turning around, such as subway trains.

11 Claims, 4 Drawing Figures

ELECTRICAL SWITCH MECHANISM

BRIEF SUMMARY OF THE INVENTION

The present invention relates to electrical switch mechanisms and particularly to switch mechanisms which are responsive to acceleration and/or deceleration.

The invention is especially suitable for use in vehicle control systems for sensing deceleration and/or acceleration of a vehicle which exceed a predetermined level. The vehicle may be a railway vehicle or train having an onboard speed control system which is automatically operable in response to control signals. The invention may be used in such systems as a vital brake assurance device to hold off emergency brake application so long as the service brakes maintain a predetermined rate of deceleration which will bring the train to a stop before reaching a section of track which is guarded by a red or stop signalling condition. The invention may also be used to limit acceleration of the train to a predetermined level.

Inasmuch as safety of operation is prerequisite in railway signalling and control systems, a failure, if any, must place the system in a safe mode of operation. Devices which guard against failures and fail in a safe mode are referred to as being vital devices. It is a feature of this invention to provide a vital switch which senses deceleration and/or acceleration events and which is vital in operation. Thus a train control system making use of a switch mechanism embodying the invention can be designed to call for brake application which will tend to bring the train to a halt which is a recognized safe condition. Certain switch devices have been recognized as vital devices in the railway signalling industry. A contact of silver which makes and breaks with a contact of silver impregnated carbon, such as used in vital relays are among such recognized vital devices, since they tend not to weld in closed or make condition. It is a feature of this invention to provide a switch which senses events of deceleration or acceleration of a predetermined value which can make use of such vital contacts.

Many trains such as subway trains must travel in opposite directions without being turned around. It is necessary in control systems for such trains to sense deceleration in opposite directions. It is a feature of this invention to provide, in an integral switch mechanism, means for sensing deceleration which does not exceed predetermined levels in both opposite directions.

Different trains and different control applications require different predetermined levels of deceleration be obtained. It is therefore necessary that the switch which senses deceleration be readily adjustable to different selected acceleration levels. It is a feature of the present invention to provide a switch mechanism which senses when predetermined levels of deceleration and acceleration are exceeded which can be readily adjusted to sense the levels of acceleration or deceleration which are required for the particular train and control system.

One device for sensing retardation, which has been offered by the Westinghouse Brake and Signal Company Ltd. of Chippenham in Great Britain, uses tubes filled with mercury. Special enclosures are needed for such tubes which require special units which must be mounted with great care. Adjustment requires turning of the entire tube. Another device is sold by Moog Corp. of East Aurora, N.Y. This device utilizes a pendulum to sense deceleration. The pendulum operates a micro switch having a snap action. Such switches are not recognized as being vital devices. Special enclosures are used in the micro switch device which must be carefully mounted in order for the device to sense predetermined levels of deceleration. Two devices are necessary to sense deceleration in opposite directions.

Accordingly, it is an object of the present invention to provide an improved electrical switch mechanism for vehicles, especially railway vehicles, for use in connection with the controlling of the speed of the vehicle during speed changing operations.

It is another object of the present invention to provide an improved override switch mechanism for use in the speed control system of a vehicle, especially a railway vehicle, to insure predetermined deceleration of the vehicle when deceleration becomes necessary as when an automatic signalling system indicates that the vehicle must come to a halt.

It is a further object of the present invention to provide an improved override switch mechanism for vehicles, especially railway trains, to assure that predetermined acceleration and/or deceleration of the vehicle is obtained.

It is a still further object of the invention to provide an improved deceleration responsive switch mechanism which is readily adjustable to provide switching action in response to different selected magnitudes of deceleration.

It is a still further object of the present invention to provide an improved deceleration responsive switch mechanism which is operable in response to deceleration in opposite directions or to deceleration and acceleration in same direction and which is readily adjustable to provide switching action in response to different selected magnitudes of deceleration in each of the opposite directions or of different magnitudes of deceleration and acceleration in the same direction.

It is a still further objective of the present invention to provide an improved deceleration and/or acceleration responsive switch mechanism for vehicles, especially railway vehicles, which is vital in operation and that any failure is to a safe mode of vehicle operation, such as full stop.

It is a still further objective of the present invention to provide an improved deceleration and/or acceleration switch mechanism for vehicles, especially railway vehicles, which can be manufactured and installed at lower cost than switch mechanisms heretofore available for the same purpose.

It is a still further object of the present invention to provide an improved deceleration and/or acceleration responsive switch mechanism for use in onboard train control systems which enables use of the same contacts as are used in conventional vital relays for such control systems.

It is a still further object of the present invention to provide an improved deceleration and/or acceleration responsive switch mechanism for use in train control systems which may be installed in the same rack as other control devices, such as the relays, of such control systems.

It is a still further object of the present invention to provide an improved deceleration switch for use in a vital relay control system which applies emergency brakes when current thereto is off; the deceleration switch being operative to provide a path for current to the vital relay only when the train is decelerating at more than a predetermined level so as to assure that the emergency brakes will be applied if the deceleration of the train does not exceed that level.

Briefly described, a switch mechanism embodying the invention has at least one set of contacts which are moveable with respect to each other between make and break positions where the contacts are in contact and apart, respectively. Means are provided for actuating the contacts from one to the other of its positions in response to a predetermined magnitude of an acceleration or deceleration event which is applied to the mechanism while maintaining the contacts in the one position, say the break position, in the absence of the predetermined magnitude of acceleration and/or deceleration. Such actuating means includes a pendulum which is pivotally moveable about an axle with respect to the vertical in opposite directions in response to deceleration and acceleration. In other words the pendulum uses the acceleration of gravity as a reference and in the absence of acceleration or deceleration is vertical. An arm is mounted upon the pendulum at a predetermined inclination with respect to the vertical and actuates the contacts to their other position, say the make position, when the pendulum moves a predetermined distance in one of these opposite directions in response to the occurrence of the predetermined magnitude of acceleration or deceleration. The two sets of contacts may be provided. Two arms, which are carried by the pendulum and mounted at predetermined inclinations with respect to the vertical and which may be different for each of the arms, may be used to actuate different ones of the two sets of contacts. The contacts may be vital contacts biased to a position, say the break position which provides for a safe mode of operation, for example application of the emergency brakes. The pendulum and the contact sets are arranged as an integral device which may be mounted in the same manner as a vital relay of an onboard train speed control system. Since each arm is independently adjustable, the switch mechanism is readily set to respond to predetermined levels or magnitudes of deceleration in opposite directions or acceleration and deceleration in the same direction.

BRIEF DESCRIPTION OF THE DRAWINGS

The foregoing and other objects, features and advantages of the invention as well as a presently preferred embodiment thereof will become more apparent from a reading of the following description in connection with the accompanying drawings in which.

DETAILED DESCRIPTION OF THE PREFERRED EMBODIMENTS

Figure 2:
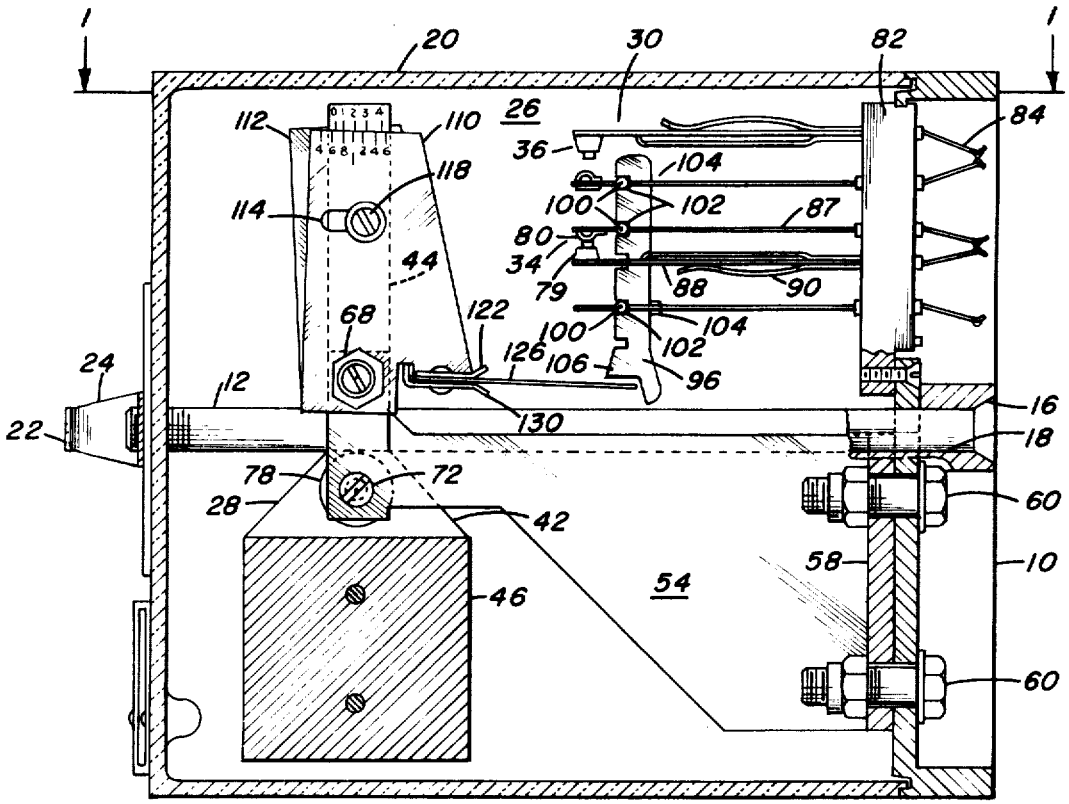
FIGS. 2 and 3 are sectional elevational views of the switch mechanism, these sections are taken along the lines 2—2 and 3—3 in FIG. 1, respectively.

Referring more particularly to the drawings, there is provided a base 10 which may be a metal casting. Two rods 12 and 14 extend laterally from the base 10. The free ends of the rods 12 and 14 are threaded. The opposite ends of the rods may be swaged as shown at 16 (FIG. 2) in countersunk holes 18 in the base 10 through which the rods 12 and 14 extend. The rods enable a cover 20 to be held against the base 10 by Z-shaped overlapping strips 22 and 24 which are screwed onto the threaded ends of the rods 12 and 14. The rods 12 and 14 are preferably metal tubes. The swage 16 at the end of the rods 12 and 14 in the casting prevents them from turning as the strips 22 and 24 are screwed on to hold the cover 20 in place.

The cover is a box, rectangular in cross-section and open at the end thereof, which meets the base 10 along the edge of its open end. The cover 20 is preferably made of clear plastic material so that the switch mechanism 26 is visable for inspection. Holes 29 in the overlapping portions of the strips 22 and 24 may receive a wire strand which is sealed with lead so as to secure the switch mechanism 26 against tampering.

The switch mechanism is made up of a pendulum assembly 28 and an assembly of two groups 30 and 32 of sets of contacts. The group 30 has a set of normally closed contacts 34 and a set of normally open contacts 36. The lower, normally closed contact set 34 may be referred to as the front contact set of the group 30, while the upper, normally open contact set 36 may be referred to as the back contact set thereof. The group 32 has a set of front contacts 38 and a set of back contacts 40. The mechanism is illustrated in the drawings in the position where the pendulum is vertical with no acceleration or deceleration forces applied to the mechanism. The envelope of the base 10 and cover 20 is preferably the same as that of a vital relay used in train control systems sold by the General Railway Signal Company of Rochester, N.Y. The base is received and mounted in a receptacle for such relays and thus can be conveniently accommodated in the onboard control system of the train. The receptacle is known as a plug board. The mechanism is mounted in line with the direction of acceleration or deceleration of the train on the plug board, such that the pendulum is vertical in the absence of deceleration or acceleration forces. Gravity is used as a reference in the operation of the switch mechanism and misalignments must be compensated either in the mounting or in the means for adjusting the actuation of the contact sets 34 to 40 which are provided on the pendulum and which will be described in detail hereinafter.

The pendulum assembly 28 has base and stem sections 42 and 44. Weights 46 and 48 are attached to opposite sides of the base section 42 at the bottom of the pendulum. An axle 50 (see FIG. 4) is secured along the vertical bi-sector of the pendulum in the stem section 44 by a pin 52 which extends laterally through the stem section 44 and through the axle 50.

Figure 4:
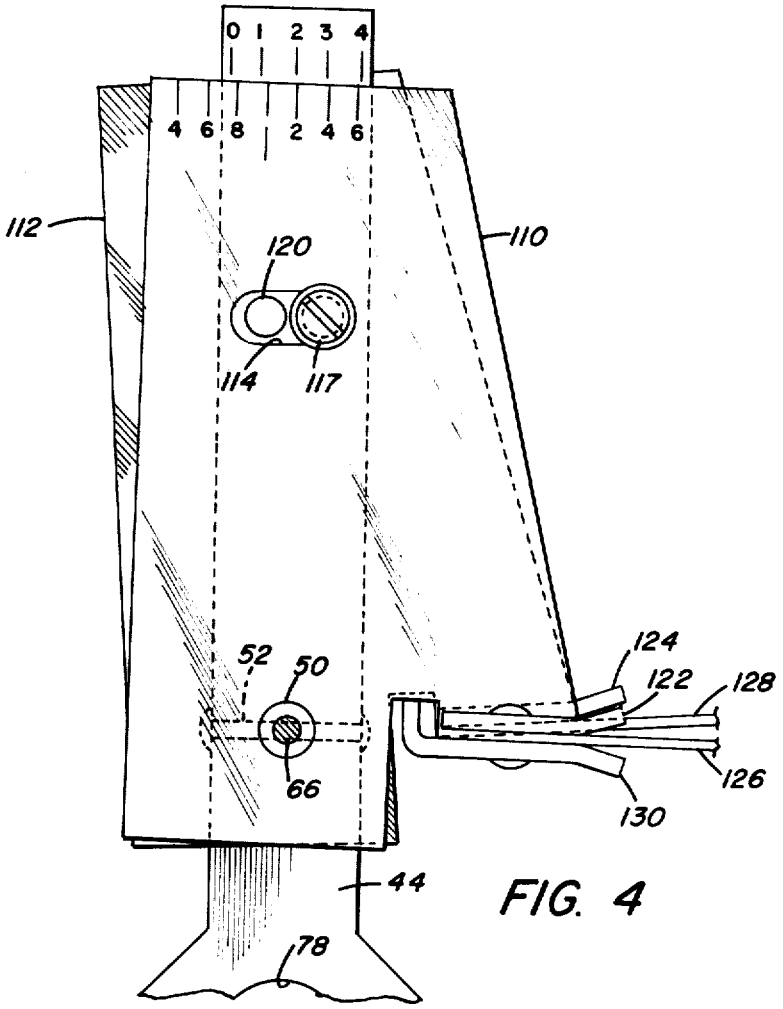
FIG. 4 is an enlarged fragmentary view in elevation showing portions of the pendulum and actuating arm adjusting mechanism of the switching mechanism which is illustrated in FIGS. 1, 2 and 3.

A pair of brackets 54 and 56 are attached, as by brazing, to a back plate 58. Nuts and bolts 60 attach the back plate to the base 10. The brackets 54 and 56 extend laterally from the base 10 parallel to each other. Bearing assemblies (not shown) within threaded rods 62 and 64 support reduced diameter ends of the axle 50 therein. One of these reduced diameter ends 66 is shown in FIG. 4. The bearing assemblies within the threaded rods 62 and 64 preferably contain jewel bearings biased toward the axle 50 by springs which are in the bearing assembly. The rods 62 and 64 with their bearing assemblies are held on the free ends of the brackets 54 and 56 by nuts 68 and 70 threaded onto the threaded rods 62 and 64.

Figure 3:
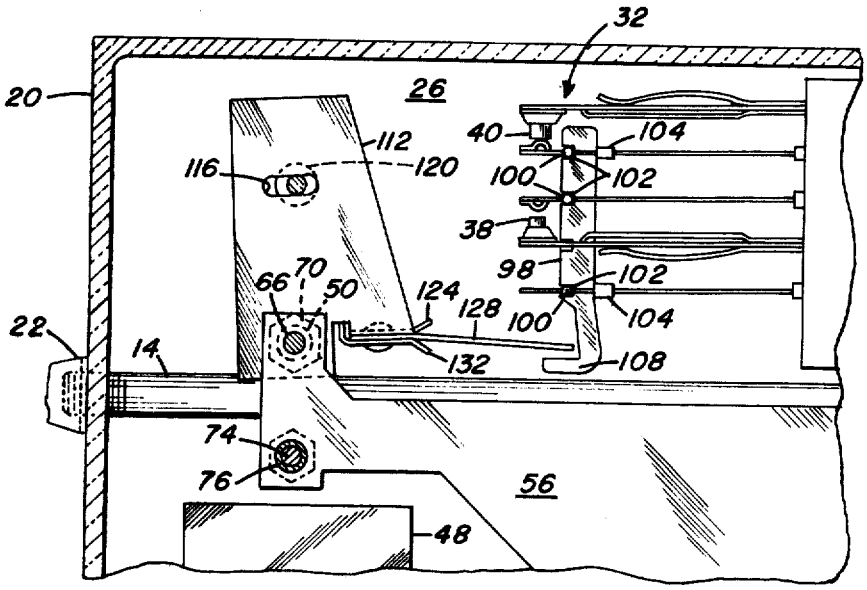

The free ends of the brackets 54 and 56, below the threaded rods 62 and 64 and their bearing assemblies, are maintained separated by a bolt and nut assembly 72. The shank 74 of the bolt 72 has a sleeve 76 thereon (see FIG. 3) which maintains the free ends of the brackets 54 and 56 separated. The shank 74 and sleeve 76 extend through a hole 78 (see FIG. 2) in the base section 42 of the pendulum, and act as a stop to prevent excessive swings of the pendulum, which might cause damage to the switch contacts in the groups 30 and 32 under extreme acceleration or deceleration.

The axle 50 has its axis horizontal and perpendicular of the pendulum. Assuming that the forward direction of movement of the train is the direction in which the closed end of the cover 20 is facing (to the left as shown in the drawings), the pendulum will swing in a clockwise direction when the train decelerates. The pendulum swings in opposite directions, clockwise and counter-clockwise, in response to deceleration and acceleration of the train. If the train is for example a subway train, which is not turned around at each end of its route, the pendulum will swing counter-clockwise when the train is decelerating and is moving from right to left. The pendulum will swing counter-clockwise when the subway train decelerates during its movement in the opposite direction, i.e. from left to right as shown in the drawing.

It is a feature of this invention to provide a single integral switch mechanism which senses when such acceleration and deceleration or deceleration in opposite directions exceeds a predetermined level. A single device in accordance with the invention rather than two devices is all that is necessary to sense opposite directions of acceleration and deceleration.

Consider next the contact groups 30 and 32. Each set of contacts, of which the normally closed contacts 34 of the group 30 are typical, is made up of a fixed contact 79 and a moveable contact 80. These contacts move between make position and break position. In the case of the contact group 30 the contact set 34 is shown in make position and the contact set 36 is shown in break position. The contacts are vital in that they are of material which does not weld or stick when current flows through the contact. The fixed contacts 79 are preferably made of a silver impregnated carbon. The moveable contacts 80 are silver. These are vital contacts of the same type that are used in vital relays of railway signalling system and are recognized as vital in the industry.

The contact groups 30 and 32 themselves may be the same construction as used in vital B-relays of railway signalling systems. Each group has room for three sets of contacts. Only two sets are used. The contacts are all mounted on the ends of leaf spring fingers which are molded into insulating blocks 82. It will be noted from FIG. 1 that there is room in the block 82 for three side by side contact groups. Only two groups are used; the center group being omitted. Contactor prongs 84 and 86 may be part of or conductively attached to the spring fingers. These connectors for each contact set are received between the prongs 84 and 86.

By way of example, the moveable contact 80 of the normally closed contact set 34 is mounted at the end of a spring finger 87. The fixed contact 79 is fixed in position by a clip 90 of stiff material which extends laterally outward from the block 82 on top and bottom sides of its spring finger 88. The moveable spring finger 87 is formed with a permanent set so that the moveable contact 80 is biased to make contact with the fixed contact 79. The normally open contact set 36 similarly has its moveable contact on a spring finger which is biased in the same direction as the spring finger 87 of the front contact set 34. The normally open contact set 36 will then be biased apart or to break contact there between.

Figure 1:
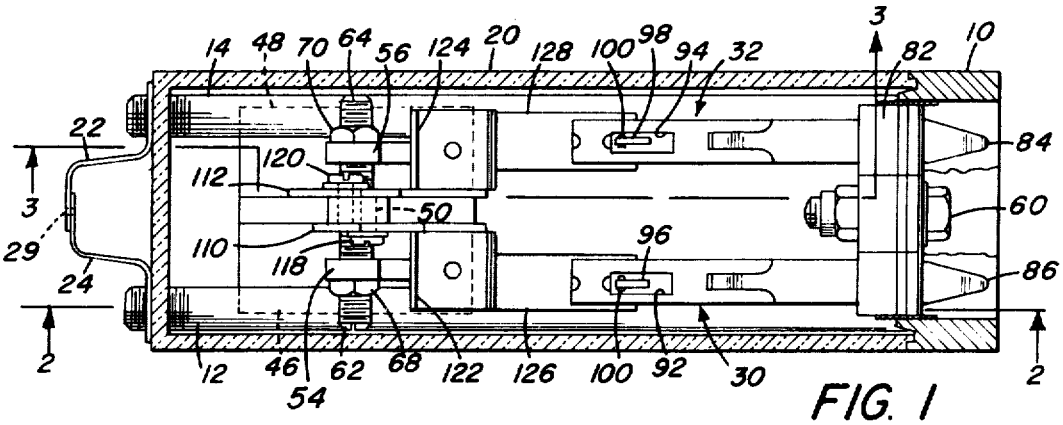
FIG. 1 is a sectional plan view of a switch mechanism provided in accordance with a presently preferred embodiment of the invention, this section being taken along the line 1—1 in FIG. 2.

Each of the spring fingers in the contact groups have slots 92 and 94 (see FIG. 1). Pushers 96 and 98 extend vertically through these slots. The slots in each of the moveable spring fingers have rollers 100 therein which are received in notches in the pushers. Bands 104 around moveable spring fingers keep the pushers in place against the rollers 100.

The pushers 96 and 98 have feet 106 and 108 at bottoms thereof. The foot 106 has its end or sole facing downwardly. The instep or top of the foot 108 faces upwardly. The sole surface of the foot 106 and the instep surface of the foot 108 present themselves for abuttment with means for actuating the contact sets 34 to 40 in the contact groups 30 and 32 from the position shown in the drawings to their opposite positions, i.e. with the normally closed contacts 34 and 40 broken and with the normally open contacts 38 and 36 making contact with each other. Such actuation occurs only when a predetermined level of deceleration is obtained in one direction in the case of the contact group 30 and in the opposite direction in the case of the contact group 32. The means for actuating the contact groups 30 and 32 is provided by the pendulum. Mounted on opposite sides of the pendulum are bracket plates 110 and 112. Each of these bracket plates is pivotally mounted about the axle 50 by reason of holes therein through which the axle 50 extends. Slots 114 and 116 in the bracket plates 110 and 112 respectively are located above the axle 50. Screws 117 and 120 extend to these slots and are threaded into the opposite sides of the stem section 44 of the pendulum. These screws, like other nuts and bolts in the mechanism may be equipped with washers of the lock or shake proof type to provide firm connections. By pivoting the bracket plates 110 and 112 about the axle 50, these plates can be set at different angles of inclination with respect to the vertical. The screws 117 and 120 are then tightened to maintain the bracket plates 110 and 112 at the preset inclinations.

Extending outwardly in opposite directions from the inside of each of the bracket plates 110 and 112 are shoes 122 and 124. Arms 126 and 128 are fixedly attached to the plates 110 and 112 by brackets 130 and 132 which are riveted to the shoes 122 and 124 and sandwich the end of the arms 126 and 128 therebetween. The free end of the arm 126 moves together with the pendulum into abutting relationship with the sole of the foot 106 of the pusher 96 when the pendulum swings in the counter-clockwise direction. This occurs only when the pendulum swings in the counter-clockwise direction a predetermined distance corresponding to a predetermined level of deceleration or acceleration depending upon the direction of forward travel of the train. The arm 126 does not make contact with the pusher 96 when the pendulum swings in the clockwise direction, since the foot is clear of the arm when it swings in the clockwise direction. Similarly the arm 128 moves into abutting relationship with the instep of the foot 108 of the pusher 98 only when the pendulum swings in the clockwise direction, and only when such a swing is over a predetermined distance. The distance of the swing corresponds to the predetermined level of acceleration or deceleration at which actuation of the switch contacts is desired. For swings in the counter-clockwise direction, the arm 128 is clear of the pusher so that the contact sets 38 and 40 in the contact group 32 remain in the position in which they are maintained by the bias of the spring fingers attached to the moveable contacts thereof.

It will be observed that the bias of the spring fingers of the moveable contact of the sets 38 and 40 is in the opposite direction to the bias of the spring fingers of the moveable contacts of the contact sets 34 and 36. Accordingly when and only when acceleration or deceleration is in one direction, which produces counter-clockwise swinging of the pendulum can actuate the contacts 34 and 36 of the group 30 be actuated. Conversely only acceleration or deceleration which produces swinging in the clockwise sense can actuate the contacts 38 and 40 of the group 32.

The level of acceleration or deceleration which will produce actuation of the contacts is readily adjusted by setting the inclination of the brackets 110 and 112 with respect to the vertical. This setting also sets the inclination of the arms 126 and 128 with respect to the vertical. The top of the stem section 44 of the pendulum is preferably calibrated in terms of deceleration rates corresponding to different inclinations from the vertical. These calibrations are indicated on a scale of from zero to four miles per hour per second (see FIGS. 2 and 4). The tops of the plates 110 and 112 are also calibrated with a vernier scale which provides a visual indication of the deceleration rates to 0.2 miles per hour per second. The pointer is set at a position between 1 and 2 mph/sec. in FIG. 2; the vernier indicating an additional 0.2 mph/sec. or a total of 1.2 mph/sec. The inclination of the arm 126 and its bracket plate 110 is then set such that the contacts in the group 30 are actuated for decelerations of 1.2 miles per hour per second. The arm 128 and its bracket plate 112 may be set at the same or such other deceleration level as may be desired. The actuation of the contact groups 30 and 32 is independent, one from the other, by virtue of the different settings and the clearance provided between the path of the arms 126 and 128 and the feet 106 and 108 of the pushers 96 and 98. The arms 126 and 128 are leaf springs similar to the spring fingers which hold the contacts 34 to 40 and will provide some deflection to relieve forces on the contacts in case of accelerations or decelerations greater than the present rate. The entire switch mechanism may be placed on a calibrating table and the scale inscribed on the plates 110 and 112 and on the stem section 44 of the pendulum.

The weights 46 are selected so that pendulum assembly 28 has a natural frequency preferably between 2 Hz and 2.5 Hz so that the switch mechanism is not responsive to vibration accelerations. Further isolation from such vibration accelerations may be provided by electrical means, such capacitors connected across the switch contacts, if desired.

From the foregoing description it will be apparent that there has been provided an improved switch mechanism which senses acceleration and deceleration events which exceed predetermined levels, which mechanism is especially suitable for use in train speed control systems for brake assurance purposes. Variations and modifications within the scope of the invention will undoubtedly suggest themselves to those skilled in the art. For example, where additional contact sets are required they may be provided outboard of the contact groups 30 and 32 or by additional contacts in the groups. Accordingly the foregoing description should be taken as illustrative and not in a limiting sense.

I claim:

1. A switch mechanism which comprises at least a first set of switch contacts which are moveable with respect to each other between make and break positions where said contacts are in contact and apart respectively, an axle, a pendulum pivotally moveable about said axle with respect to the vertical in first and second opposite directions in response to deceleration and acceleration events in said opposite directions, an arm mounted on said pendulum for actuating said contacts when said pendulum moves a predetermined distance in one of said opposite directions in response to the occurrence of a predetermined level of one of said acceleration and deceleration events which is applied to said mechanism, means pivotally supporting said arm on said pendulum and for adjusting the position of said arm on said pendulum to selected different inclinations with respect to the vertical for selecting said predetermined level of said one event upon occurrence of which said first set of contacts is actuated to said other position thereof.

2. A switch mechanism which comprises at least a first set of switch contacts which are moveable with respect to each other between make and break positions where said contacts are in contact and apart respectively, an axle, a pendulum pivotally moveable about said axle with respect to the vertical in first and second opposite directions in response to deceleration and acceleration events in said opposite directions, an arm mounted on said pendulum for actuating said contacts when said pendulum moves a predetermined distance in one of said opposite directions in response to the occurrence of a predetermined level of one of said deceleration and acceleration events applied to said mechanism, a second set of switch contacts which are moveable with respect to each other between make and break positions where said contacts are in contact and apart respectively, a second arm mounted on said pendulum for actuating said second set of contacts to the other of said positions thereof when the pendulum moves a predetermined distance in the other of said opposite directions in response to the occurrence of a predetermined level of the other of said events, means pivotally supporting said first arm on said pendulum for adjusting the position of said first arm on said pendulum to selected different inclinations with respect to the vertical for selecting said predetermined magnitude of said one event upon occurrence of which said first set of contacts is actuated, and means pivotally supporting said second arm on said pendulum for adjusting the position of said second arm on said pendulum to selected different inclinations with respect to the vertical for selecting the predetermined magnitude of said other event upon occurrence of which said second set of contacts is actuated.

3. The invention as set forth in claim 1 wherein said pendulum has a stem with a weight connected thereto, said stem being mounted on said axle with said weight disposed below said stem and said stem disposed above said axle, a plate pivotally mounted on said axle, said arm and said plate being fixedly attached to each other, a slot in said plate, a screw extending through said slot and being received in said stem for securing said plate to said stem with said arm adjusted at selected different inclinations with respect to the vertical.

4. The invention as set forth in claim 2 wherein said pendulum has a stem with a weight connected thereto, said stem being mounted on said axle with said weight being disposed below and said stem above said axle, first and second plates on opposite sides of said stem, said first named arm being fixedly attached to said first plate and said second arm being fixedly attached to said second plate, each of said plates being pivotally mounted on said axle, said plates having slots therein, screws extending through said slots into said stem on said opposite sides thereof for securing said plates to said stem with said first and second arms independently adjusted at the selected different inclinations thereof to the vertical.

5. A switch mechanism which comprises at least a first set of switch contacts which are moveable with respect to each other between make and break positions where said contacts are in contact and apart respectively, an axle, a pendulum pivotally moveable about said axle with respect to the vertical in first and second opposite directions in response to deceleration and acceleration events in said opposite directions, an arm mounted on said pendulum for actuating said contacts when said pendulum moves a predetermined distance in one of said opposite directions in response to the occurrence of a predetermined magnitude of one of said events which is applied to said mechanism, said first set of switch contacts comprising a fixed contact and a contact moveable in opposite directions of travel, said moveable contact being mounted on a spring finger biasing said moveable contact in one direction of said opposite directions of travel to bring said contacts to one position thereof, a pusher in engagement with said spring finger and moveable therewith in the other of said opposite direction of travel, said pusher having a foot presenting a face in the other of said two opposite travel directions in abutting relationship with said arm when said pendulum pivots said predetermined distance in said one direction for actuating said first set of contacts to said other position thereof.

6. A switch mechanism which comprises at least a first set of switch contacts which are moveable with respect to each other between make and break positions where said contacts are in contact and apart respectively, an axle, a pendulum pivotally moveable about said axle with respect to the vertical in first and second opposite directions in response to acceleration and deceleration events in said opposite directions, an arm mounted on said pendulum for actuating said contacts when said pendulum moves a predetermined distance in one of said opposite directions in response to the occurrence of a predetermined level of one of said events applied to said mechanism, a second set of switch contacts which are moveable with respect to each other between make and break positions where said contacts are in contact and apart respectively, a second arm mounted on said pendulum for actuating said second set of contacts to the other of said positions thereof when the pendulum moves a predetermined distance in the other of said opposite directions in response to the occurrence of a predetermined magnitude of said other event, said first set of switch contacts comprising a fixed contact and a contact moveable in two opposite directions of travel, said moveable contact being mounted on a first spring finger biasing said moveable contact in one direction of said two opposite directions of travel to bring said first set of contacts to one of said positions thereof, said second set of switch contacts also comprising a fixed contact and a contact moveable in said opposite directions of travel, a second spring finger on which said second set moveable contact is mounted, said second spring finger biasing said second set of contacts in the other of said opposite directions of travel to bring said second set of contacts to said one position thereof, a first pusher in engagement with said first spring finger and moveable therewith, a second pusher in engagement with second spring finger and moveable therewith, said first pusher having a foot presenting a face in the other of said opposite travel directions in abutting relationship with said first named arm when said pendulum pivots said predetermined distance in said one direction for actuating said first set of contacts independently of said second set of contacts to the other position thereof, said second pusher presenting a foot presenting a face in said one of said opposite travel directions in abutting relationship with said second arm when said pendulum pivots said predetermined distance in said other direction for actuating said second contacts to said other position thereof independently of said first contacts.

7. The invention as set forth in claim 5 further comprising a first additional set of contacts also having a fixed contact and contact moveable in said two opposite directions of travel, said moveable contact of said first additional set being mounted on an additional spring finger, said spring finger of said first set moveable contact and of said first additional set moveable contact both being in engagement and moveable with said pusher, said spring fingers of said first and first additional contact sets being biased in said one of said opposite directions of travel to bring said first contacts to said one of said positions thereof and said first additional set of contacts to a position other than said one of said positions of said first contacts.

8. The invention as set forth in claim 6 further compising a first additional set of contacts also having have a fixed contact and a contact moveable in said two opposite directions of travel, said moveable contact of said first additional set of contacts being mounted on a first additional spring finger, said first spring finger of said first set moveable contact and of said first additional set moveable contact both being in engagement and moveable with said first pusher, said first spring finger and said first additional spring finger being biased in said one of said opposite directions of travel to bring said first contacts to said one of said positions thereof and said first additional contacts to a position opposite to the position of said first contacts, a second additional set of contacts also having a fixed contact and a contact moveable in said two opposite directions of travel, said additional set being mounted on a second additional spring finger, said second spring finger and said second additional spring finger being in engagement and moveable with said second pusher, said second spring finger and said second additional spring finger both being biased in said other of said opposite directions of travel to bring said second contact to said one of said positions thereof and said second additional contact to a position opposite to said one of said positions thereof.

9. The invention as set forth in claim 6 wherein said first and second arms are attached to said pendulum on opposite sides thereof and extend laterally therefrom toward said pushers, said directions of travel of said pushers being essentially vertical and said first and second pushers being in alignment with said first and second arms respectively.

10. The invention as set forth in claim 9 further comprising a base bracket means extending laterally from said base for supporting said axle, means attaching said spring fingers cantilevered at one end thereof in insulating relationship to said base with said fingers extending laterally toward said pendulum, and means for supporting said fixed contacts from said base adjacent to said moveable contacts of their respective contact sets.

11. The invention as set forth in claim 6 wherein said first and second arms are leaf springs.

* * * * *